US009847192B2

(12) United States Patent
Mizutani et al.

(10) Patent No.: US 9,847,192 B2
(45) Date of Patent: Dec. 19, 2017

(54) PUSH BUTTON KEYBOARD DEVICE

(71) Applicant: LENOVO (SINGAPORE) PTE. LTD., Singapore (SG)

(72) Inventors: Akihiko Mizutani, Kanagawa-ken (JP); Fusanobu Nakamura, Kanagawa-ken (JP); Mitsuhiro Yamazaki, Kanagawa-ken (JP)

(73) Assignee: LENOVO (SINGAPORE) PTD LTE, Singapore (SG)

( * ) Notice: Subject to any disclaimer, the term of this patent is extended or adjusted under 35 U.S.C. 154(b) by 0 days.

(21) Appl. No.: 14/659,841

(22) Filed: Mar. 17, 2015

(65) Prior Publication Data

US 2016/0005557 A1 Jan. 7, 2016

(30) Foreign Application Priority Data

Mar. 18, 2014 (JP) ..... 2014-055607

(51) Int. Cl.

| | |
|---|---|
| ***H01H 13/702*** | (2006.01) |
| ***H01H 13/704*** | (2006.01) |
| ***H01H 13/85*** | (2006.01) |
| *H01H 3/12* | (2006.01) |

(52) U.S. Cl.

CPC ..... *H01H 13/702* (2013.01); *H01H 13/704* (2013.01); *H01H 13/85* (2013.01); *H01H 3/125* (2013.01); *H01H 2215/004* (2013.01); *H01H 2215/028* (2013.01); *H01H 2215/052* (2013.01); *H01H 2221/044* (2013.01)

(58) Field of Classification Search

CPC .... H01H 13/702; H01H 13/704; H01H 13/85; H01H 2215/052

USPC ..... 310/328; 200/181

See application file for complete search history.

(56) References Cited

U.S. PATENT DOCUMENTS 7,952,261 B2 * 5/2011 Lipton ..... G06F 3/016 310/328
9,448,628 B2 * 9/2016 Tan ..... G06F 3/016

(Continued)

FOREIGN PATENT DOCUMENTS

CN 101999111 A 3/2011
CN 102109921 A 6/2011

(Continued)

OTHER PUBLICATIONS

Savioz et al., "Towards multi-finger haptic devices: a computer keyboard with adjustable force feedback.", Electrical Machines and Systems (ICEMS), 2011 International Conference—Beijing, pp. 1-6, Aug. 20-23, 2011.

*Primary Examiner* — J. San Martin
(74) *Attorney, Agent, or Firm* — Antony P. Ng; Russell Ng PLLC

(57) ABSTRACT

A keyboard device is disclosed. The keyboard device includes a base, a key top, a film actuator, a position sensor, and a controller. The key top is movably arranged on the upper surface side of the base. Disposed between the base and the key top, the film actuator bends according to an applied voltage. Also disposed between the base and the key top, the position sensor detects a position of the key top. The controller applies a voltage to the film actuator in order to generate a repulsive force corresponding to the position of the key top detected by the position sensor.

8 Claims, 10 Drawing Sheets

STATE IN WHICH INITIAL VOLTAGE IS BEING APPLIED (TOP POSITION)

STATE IN WHICH VOLTAGE IS NOT BEING APPLIED (BOTTOM POSITION)

(56) References Cited

U.S. PATENT DOCUMENTS

| | | | | |
|---|---|---|---|---|
| 2008/0117166 | A1* | 5/2008 | Rosenberg | F41A 17/06 345/156 |
| 2008/0251364 | A1* | 10/2008 | Takala | H01H 13/85 200/341 |
| 2011/0038625 | A1 | 2/2011 | Zellers et al. | |
| 2013/0335354 | A1 | 12/2013 | Zellers et al. | |

FOREIGN PATENT DOCUMENTS

| | | |
|---|---|---|
| JP | 2000-294080 | 10/2000 |
| JP | 2008-234549 | 10/2008 |
| WO | 2013122368 A | 8/2013 |

* cited by examiner

STATE IN WHICH INITIAL VOLTAGE IS BEING APPLIED (TOP POSITION)

STATE IN WHICH VOLTAGE IS NOT BEING APPLIED (BOTTOM POSITION)

A-A CROSS-SECTION

B-B CROSS-SECTION

PUSH BUTTON KEYBOARD DEVICE

PRIORITY CLAIM

The present application claims benefit of priority under 35 U.S.C. §§120, 365 to the previously filed Japanese Patent Application No. JP2014-055607 with a priority date of Mar. 18, 2014, which is incorporated by reference herein.

BACKGROUND OF THE INVENTION

1. Technical Field

The present invention relates to keyboard devices in general, and particularly to a keyboard device used in an electronic apparatus.

2. Description of Related Art

A keyboard device used in an electronic apparatus such as a laptop personal computer (laptop PC) is normally equipped with a base plate, a membrane sheet provided on the upper or lower surface of the base plate, and a key top vertically movably arranged on the upper surface side of the base plate by a pantograph. In such a keyboard device, the corresponding signal is output to a key depressed by making contacting/separating action of the contact of the membrane sheet when the key top is depressed. When the depression of the key top is released, the key top is reset to its original position by the elastic force of a rubber dome (elastic member) provided inside.

The keyboard device generates a suitable repulsive force (or biasing force) when a user depresses the key top with a configuration based on the pantograph and the rubber dome and realizes high usability. To make a thinner keyboard device is relatively difficult because of the usage of rubber domes. For one prior art thin keyboard design, an actuator is placed thereinside and a haptic feedback (or vibration) is provided when a key is depressed. One problem with this thin keyboard design is that vibration is different in touch from the "click" of a key, and the usability is degraded with no suitable repulsive force. Consequently, it would be desirable to provide an improved thin keyboard design.

SUMMARY OF THE INVENTION

In accordance with a preferred embodiment of the present invention, a keyboard device includes a base, a key top, a film actuator, a position sensor, and a controller. The key top is movably arranged on the upper surface side of the base. Disposed between the base and the key top, the film actuator bends according to an applied voltage. Also disposed between the base and the key top, the position sensor detects a position of the key top. The controller applies a voltage to the film actuator in order to generate a repulsive force corresponding to the position of the key top detected by the IC position sensor.

All features and advantages of the present disclosure will become apparent in the following detailed written description.

BRIEF DESCRIPTION OF THE DRAWINGS

The disclosure itself, as well as a preferred mode of use, further objects, and advantages thereof, will best be understood by reference to the following detailed description of an illustrative embodiment when read in conjunction with the accompanying drawings, wherein.

DETAILED DESCRIPTION OF A PREFERRED EMBODIMENT

A keyboard device, a push button device and an electronic apparatus according to the present invention will hereinafter be described in detail based on the accompanying drawings. It will be readily understood that the components of the present invention, as generally illustrated in the figures of the present specification, may be arranged and designed widely in various ways in a variety of different configurations. Thus, the following more detailed description of the embodiments of the device, system and method of the present invention is not intended to limit the scope of the present invention as claimed, but is merely representative of one example of the selected embodiment of the present invention, and is merely illustrative of the selected embodiment related to the device, system and method without inconsistency with the present invention as claimed in the present specification. One skilled in the related art will recognize that the present invention can be practiced even without one or more of the specific details or even with other methods, components and materials. Incidentally, the present invention is not limited by this embodiment. Further, the components in the following embodiments include one that can be assumed easily by one skilled in the related art, or the substantially the same one. The following embodiments and modifications may respectively be practiced independently, or parts or all thereof may be practiced in combination.

Figure 1:
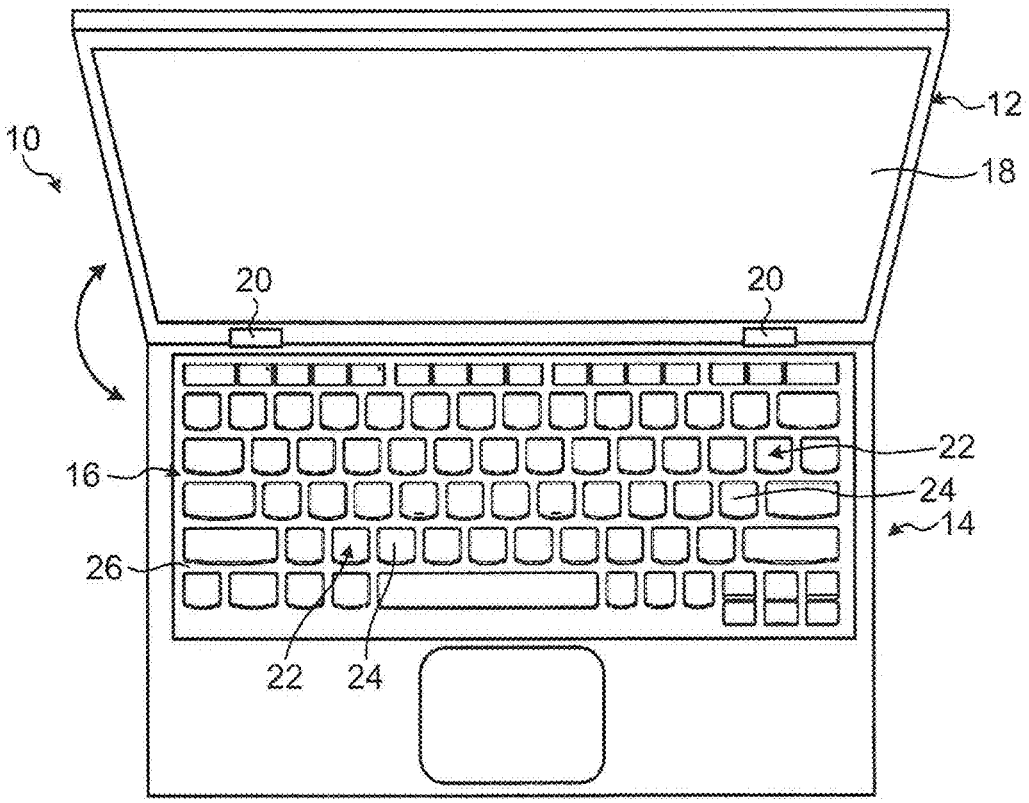
FIG. 1 is a diagram of an electronic apparatus in which a keyboard device according to a preferred embodiment of the present invention can be incorporated.

FIG. 1 is a diagram of a laptop PC 10 to which a keyboard device according to a preferred embodiment of the present invention is applied. As shown, the laptop PC 1.0 is equipped with a main body side chassis 14 and a display side chassis 12 both of which are substantially parallelepiped. The main body side chassis 14 and the display side chassis 12 are coupled to each other by a pair of right and left hinges 20 at their ends. The hinges 20 openably/closably support these chassis.

The display side chassis 12 is provided with a display 18. The display 18 is configured by, for example, a touch panel type liquid crystal display device. The main body side chassis 14 accommodates thereinside a substrate (not shown) equipped with various electronic parts such as a keyboard controller (refer to FIG. 5) that controls the operation of the keyboard device 16, a main controller that controls the entire apparatus, a display controller that controls the display 18, etc. and includes the keyboard device 16 exposed at the upper surface of the main body side chassis 14.

The keyboard device 16 is an isolation type keyboard device equipped with a plurality of keys (key switches) 22, and a frame (or isolation frame) 26 that fills a gap surrounding a key top 24 constituting an operation surface of each key 22. Namely, in the keyboard device 16, the frame 26 partitions between the key tops 24 and other adjacent key tops 24, and the partitioned key tops 24 are respectively arranged independently.

The frame 26 is a frame body formed with a plurality of holes through which the key tops 24 of the keys 22 are inserted in a sheet of plate-like member formed of a resin or the like.

The keyboard device 16 is connected to the keyboard controller. When an operator depresses the key top 24, a signal corresponding to the key 22 depressed by making contacting/separating action of the contact of a membrane sheet (not shown) (when the key switch is in a state of ON) is output to the keyboard controller.

In the present embodiment, in order to generate a repulsive force suitable for a user where the key top 24 is depressed while thinning the keyboard device 16, a film actuator is used in the keyboard device 16.

Figure 2:
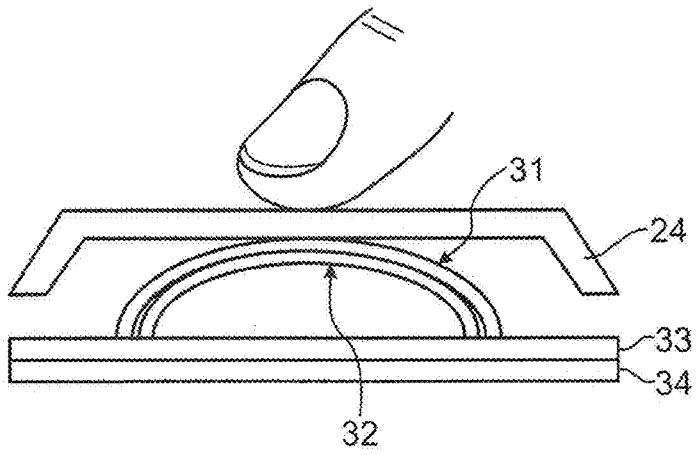
FIG. 2 is a diagram illustrating a repulsive force of a key in a keyboard device.

FIG. 2 is a diagram showing the repulsive force of the key 22 in the keyboard device 16. As illustrated in FIG. 2, the key 22 is equipped with a key top 24, a film actuator 31, a position sensor 32 that detects the position of the key top 24, a cushion plate 33, and a base plate 34. In the same figure, the illustration of a switch mechanism (membrane sheet or the like) is omitted for ease of explanation.

The key top 24 has a surface which serves as an operation surface depressed by the operator upon depressing the key 22. The film actuator 31 applies a repulsive force (biasing force) in the direction to return the key top 24 to its original position when the key top 24 is depressed. Both end sides of the film actuator 31 are fixed to the base plate 34.

Figure 3:
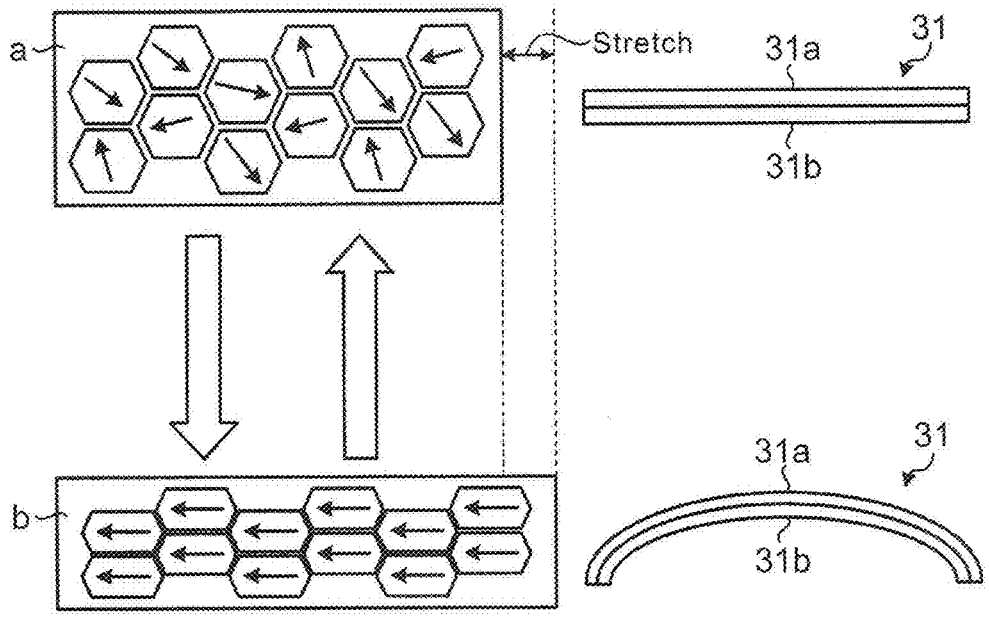
FIG. 3 is a diagram illustrating the principle of a film actuator.
Figure 4A:
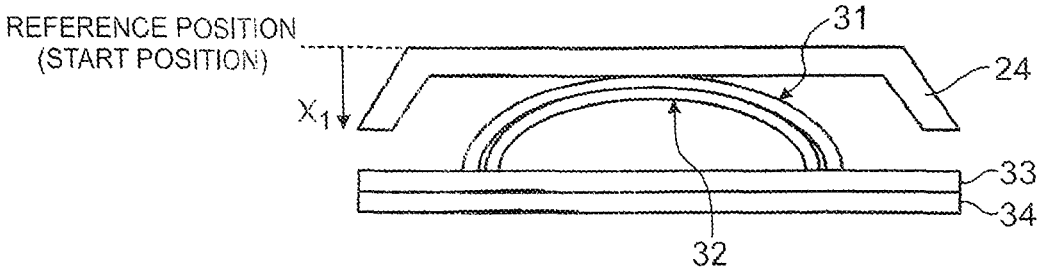
FIG. 4A is a diagram showing a top positions of a key.
Figure 4B:
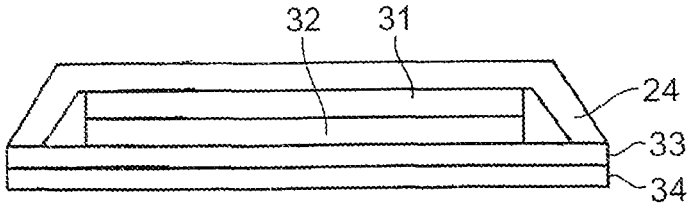
FIG. 4B is a diagram showing a bottom positions of a key.

FIG. 3 is a diagram showing the principle of the film actuator 31. FIG. 4 is a diagram describing the top and bottom positions of the key top 24. In FIG. 3, the film actuator 31 has, for example, a structure made by binding two of a piezoelectric polymer 31*a* and a non-piezoelectric film 31*b* such as a PET film together (e.g., Electrical-Mechanical Polymers (EMP) actuator). The film actuator 31 makes use of the PET film 31*b* being bent by stretching of the piezoelectric polymer 31*a* by the application of a voltage. FIG. 3*a* illustrates a state in which no voltage is applied to the piezoelectric polymer 31*a*, and FIG. 3*b* illustrates a state in which the voltage is applied to the piezoelectric polymer 31*a*.

In FIG. 4, since the film actuator 31 does not stretch in the state in which no voltage is applied thereto, as illustrated in (bottom position), the key top 24 is at the bottom position without being pushed up. When an initial voltage is applied to the film actuator 31 as illustrated in (top position), the film actuator 31 is bent by its stretching to push the key top 24 upwards, so that the key top 24 is at the top position. This top position is referred to as a reference position (or start position). The position of the key top 24 is set with an X1 direction defined as a plus direction (refer to FIG. 6).

The position sensor 32 is for detecting the position of the key top 24 and can use the same material as the film actuator 31, for example. When the film actuator is bent, the polarization of the piezoelectric polymer 31*a* is aligned in direction to generate a polarization potential. It is therefore possible to detect the position of the key top 24 by measuring the potential. When the film actuator is used as the position sensor 32 (hereinafter referred to as a film sensor 32), both end sides of the film sensor 32 are fixed to the base plate 34, and the position (height) of the key top 24 is set to correspond to the bending of the film sensor 32 one on one. Incidentally, although a description has been made about the example in which the film sensor is used as the position sensor 32, an electrostatic sensor or a distance sensor may be used.

Figure 5:
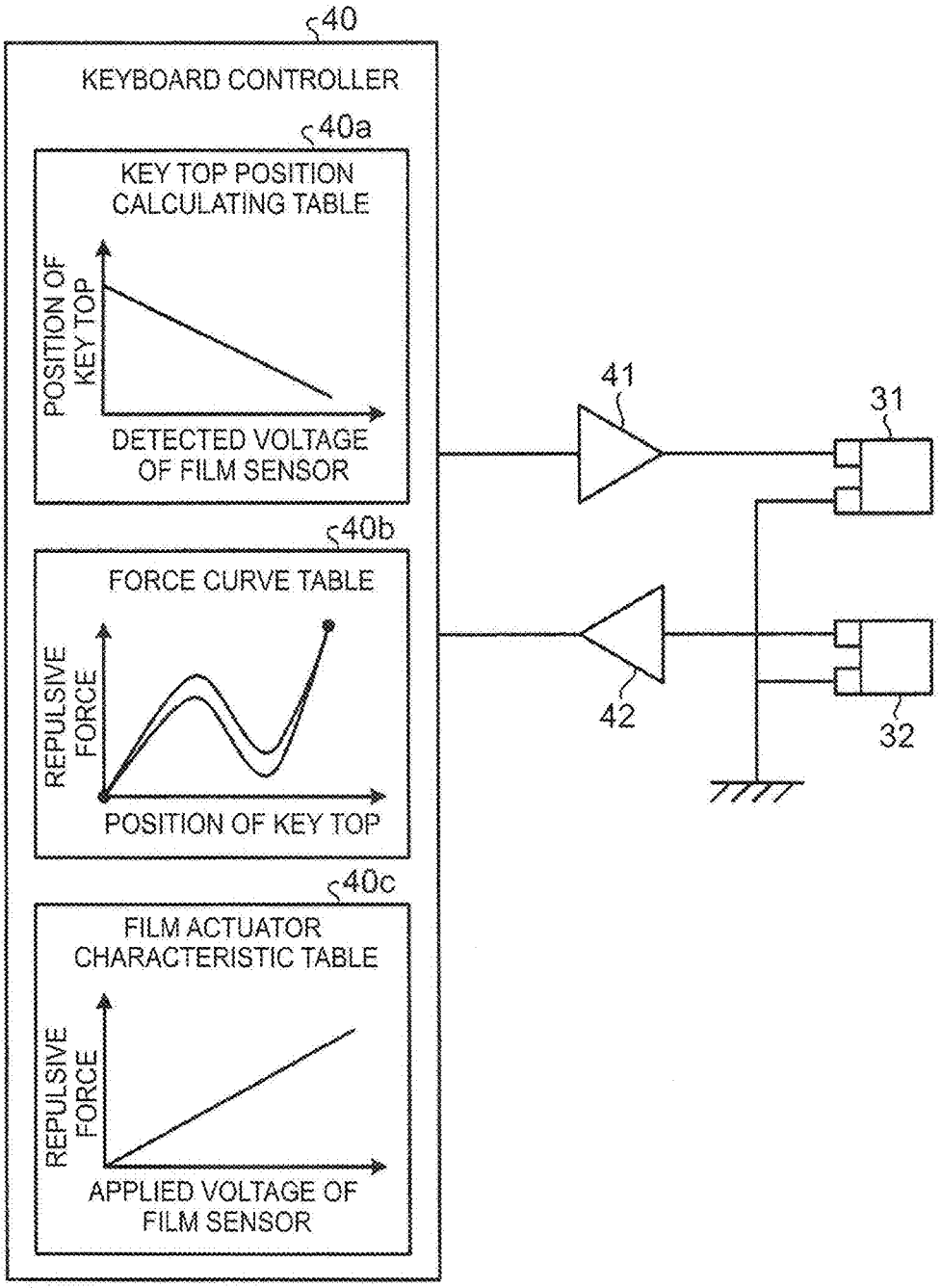
FIG. 5 is a diagram illustrating a configuration example of a film actuator control circuit.

FIG. 5 is a diagram illustrating a configuration example of a film actuator control circuit related to the control of the repulsive force of the film actuator 31. The film actuator control circuit is equipped with a keyboard controller 40, a driver 41, and an amplifier 42 as illustrated in FIG. 5. The keyboard controller 40 detects the position of the key top 24, based on the voltage detected by the film sensor 32 and applies a voltage for generating a repulsive force corresponding to the position of the key top 24 to the film actuator 31.

The keyboard controller 40 is equipped with a key top position calculating table 40*a*, a force curve table 40*b*, and a film actuator characteristic table 40*c*. The key top position calculating table 40*a* is a table that defines the relationship between the detected voltage of the film sensor 32 and the position (or height) of the key top 24. The force curve table 40*b* is a table that defines the relationship between the position of the key top 24 and the repulsive force generated by the film actuator 31. The film actuator characteristic table 40*c* is a table that defines the relationship between the repulsive force generated by the film actuator 31 and the drive voltage to be applied to the film actuator 31. These tables are calculated by experiment, simulation or the like.

The driver 41 amplifies the voltage outputted from the keyboard controller 40 and applies the same to the film actuator 31. The amplifier 42 amplifies the detected voltage of the film sensor 32 and outputs the same to the keyboard controller 40.

Figure 6:
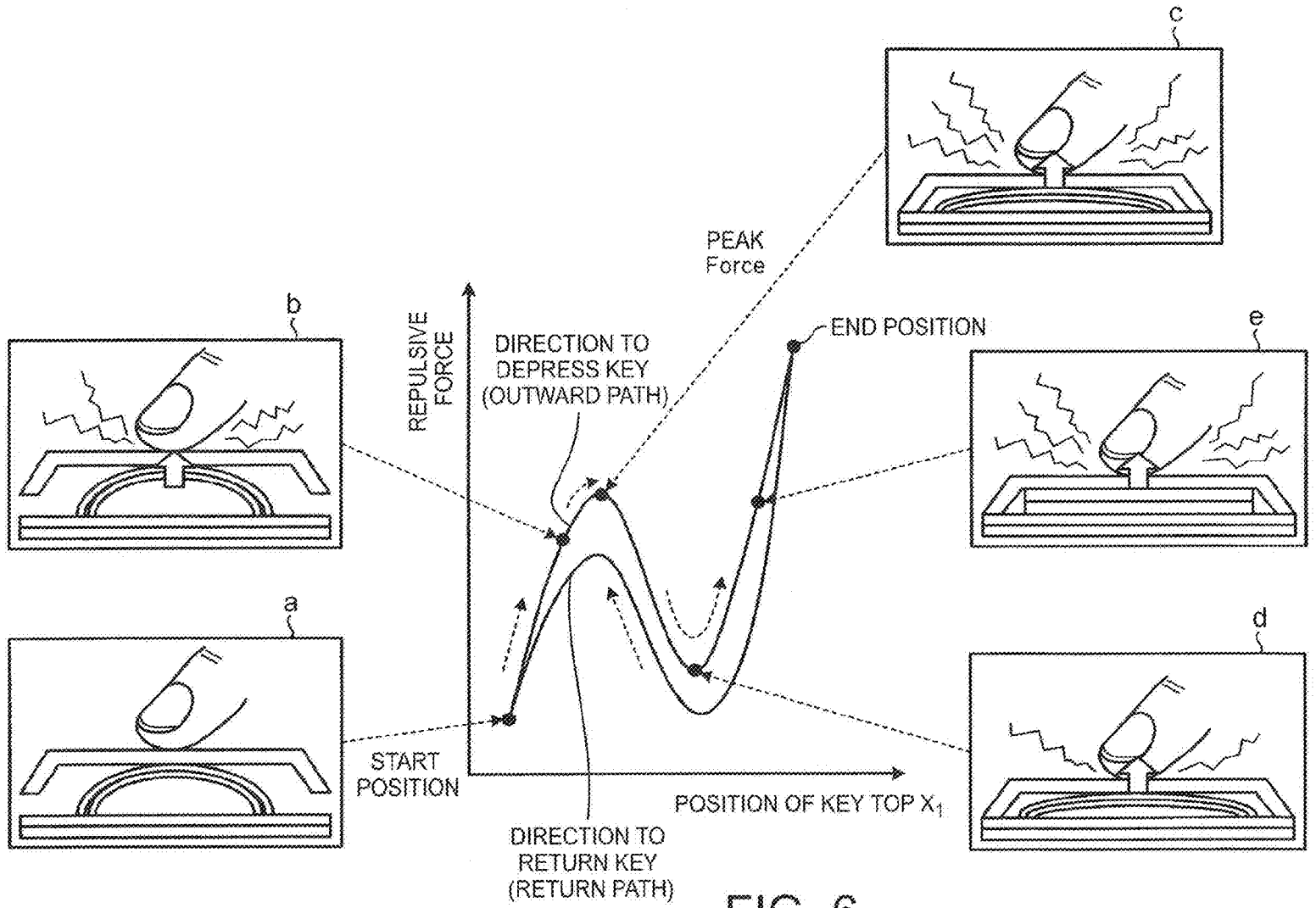
FIG. 6 is a diagram describing the relationship between a force curve table and the position of a key top at states (a)-(e)

FIG. 6 is a diagram showing one example of the relationship between the force curve table 40*b* and the position of the key top 24. An example of a force curve illustrated in FIG. 6 is illustrated as a similar force curve as a rubber dome, and the shape of the force curve can be arbitrarily set (programmed). The force carve table 40*b* may change the force curve in the direction (outward path) to depress the key top 24 and the direction (return path) to return the key top 24 or may reduce the repulsive force in the direction to return the key top 24 more than that in the direction to depress the key top 24.

In FIG. 6, the start position is in a state (a) in which the initial voltage is applied to the film actuator 31 so that the key top 24 is pushed up to be at the top position (reference position). As the key top 24 is pressed, the repulsive force of the film actuator 31 gradually increases (b). The repulsive force is at the peak (c) in, for example, a position where the key switch assumes a state of ON. After that, the repulsive force is reduced (d), and thereafter the repulsive force is increased again (e) to rise to an end position.

Incidentally, a plurality of force curves (e.g., a force curve small in repulsive force, a force curve large in repulsive force, etc.) may be prepared and configured to be selectable according to the preference of the user.

Figure 7:
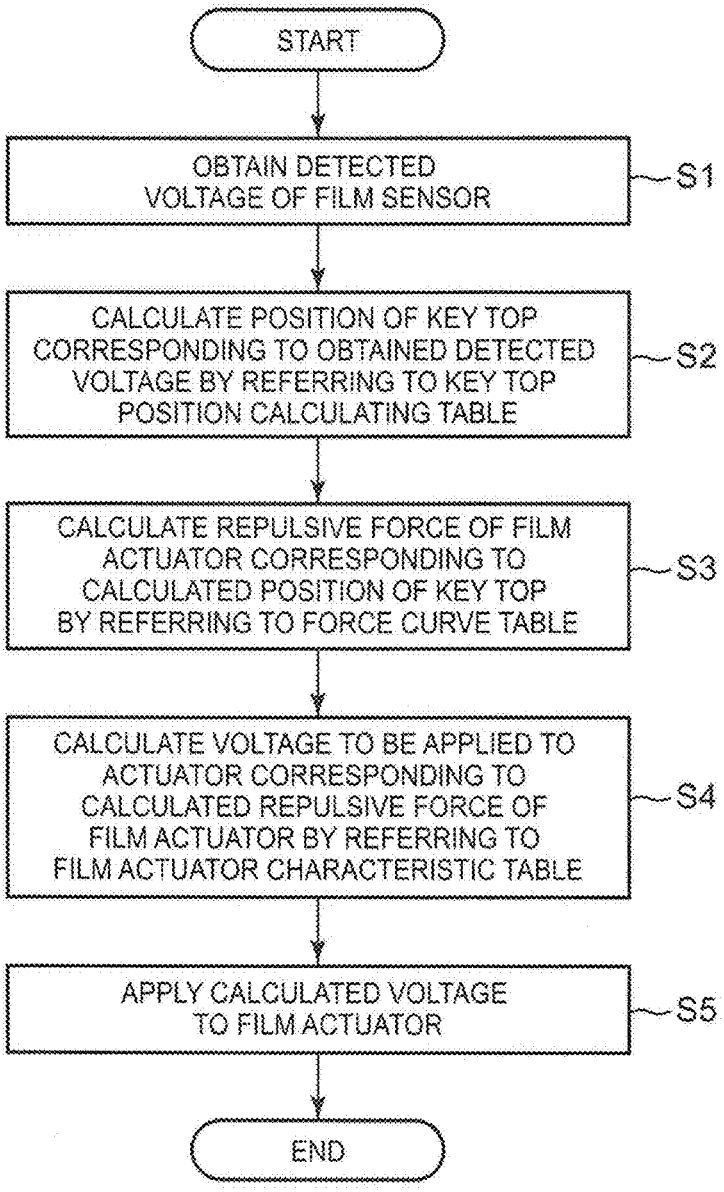
FIG. 7 is a flowchart of a method for controlling a repulsive force of a film actuator by a keyboard controller.

FIG. 7 is a flowchart of a method for controlling the repulsive force of the film actuator 31 by the keyboard controller 40. The keyboard controller 40 repeatedly performs the processing illustrated in the flowchart of FIG. 7 in a predetermined cycle. In FIG. 7, the keyboard controller 40 obtains the detected voltage of the film sensor 32 through the amplifier 42 (Step S1). Since the detected voltage of the film sensor 32 corresponds to the position of the key top 24 as described above, the position of the key top 24 can be detected by detecting the voltage of the film sensor 32. The keyboard controller 40 calculates the position of the key top 24 corresponding to the thus obtained detected voltage by referring to the key top position calculating table 40*a* (Step S2).

The keyboard controller 40 calculates a repulsive force of the film actuator 31 corresponding to the calculated position of the key top 24 by referring to the force curve table 40*b* (Step S3). Subsequently, the keyboard controller 40 calculates a voltage to be applied to the film actuator 31 corresponding to the calculated repulsive force of the film actuator 31 by referring to the film actuator characteristic table 40*c* (Step S4). Afterwards, the keyboard controller 40 applies the calculated voltage to the film actuator via the driver 41 (Step S5). Thus, the repulsive force corresponding to the position of the key top 24 occurs in the film actuator 31.

Incidentally, although the position of the key top 24, the repulsive force of the film actuator 31 and the voltage applied to the film actuator 31 are calculated using the tables here, they may be calculated using operational expressions. Further, although the voltage for generating the repulsive force of the film actuator 31 corresponding to the position of the key top 24 is calculated using the two two-dimensional tables of the force curve table 40*b* and the film actuator characteristic table 40*c*, it may be calculated using a three-dimensional table that defines the relationship among the position of the key top 24, the repulsive force of the film actuator 31 and the voltage applied to the film actuator 31.

Figure 8:
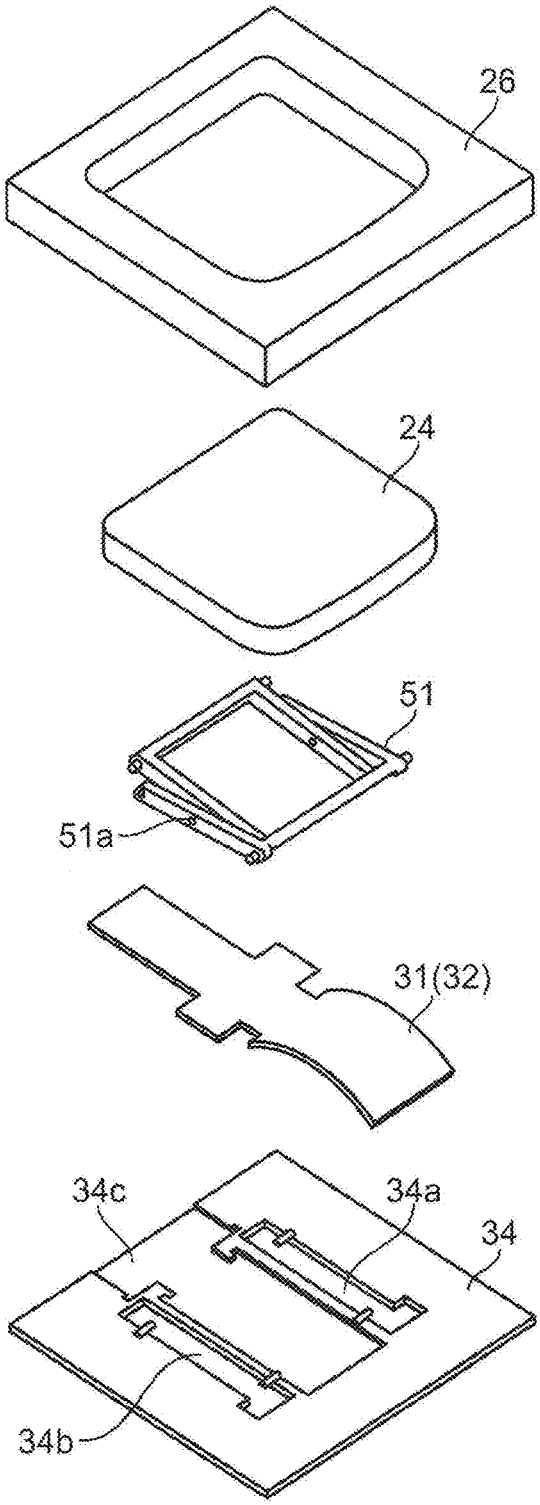
FIG. 8 is an exploded perspective diagram of a key provided in the keyboard device.
Figure 9:
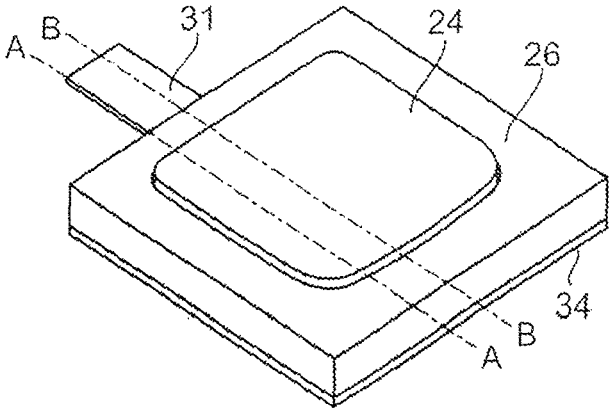
FIG. 9 is a perspective diagram of a key where a key top is at a top position.
Figure 9A:
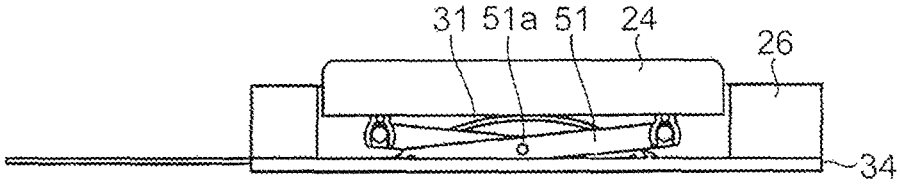
FIG. 9A is a cross-sectional diagram of the key from FIG. 9 taken along line A-A.
Figure 9B:
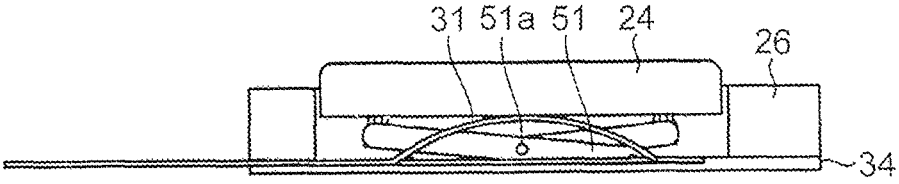
FIG. 9B is a cross-sectional diagram of the key from FIG. 9 taken along B-B.
Figure 10:
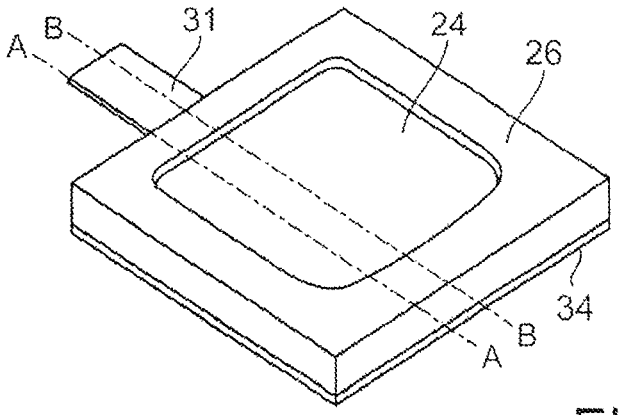
FIG. 10 is a perspective diagram of a key where a key top is at a bottom position.
Figure 10A:
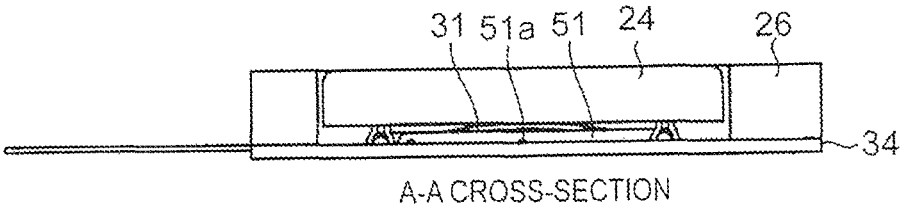
FIG. 10A is a cross-sectional diagram of the key from FIG. 10 taken along line A-A.
Figure 10B:
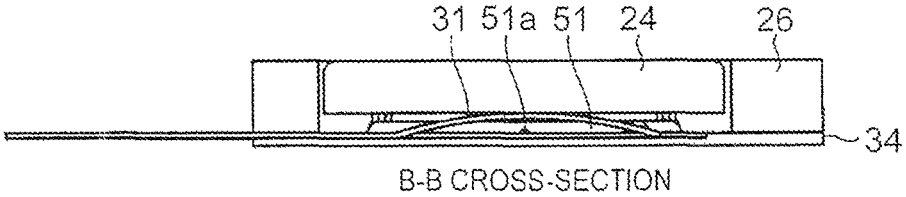
FIG. 10B is a cross-sectional diagram of the key from FIG. 10 taken along B-B.

A schematic configuration example of the keyboard device 16 according to the present embodiment will next be described. FIG. 8 is an exploded perspective diagram of the key 22 provided in the keyboard device 16 as viewed from above. FIG. 9 is a perspective diagram of the key 22 where the key top 24 is at a top position; FIG. 9A illustrates a cross-section taken along line A-A thereof; and FIG. 9B illustrates a cross-section taken along line B-B thereof. FIG. 10 is a perspective diagram of the key 22 where the key top 24 is at a bottom position; and FIG. 10A illustrates a cross-section taken along line A-A thereof; and FIG. 10B illustrates a cross-section taken along B-B thereof. The illustration of a configuration related to the switch of the key 22 is omitted in FIG. 8 to FIG. 10 for simplicity of description.

In FIG. 8 to FIG. 10, the key top 24 is formed to be almost rectangular plate-like, and the surface thereof serves as an operation surface depressed by the user. The frame 26 is formed of a resin or the like and is a frame body formed with a hole that inserts the key tops 24 therethrough.

A guide mechanism (pantograph) 51 guides the up/down movement of the key top 24 accompanied with its depression operation. In other words, the guide mechanism 51 guides the depression and return movements of the key top 24. The guide mechanism 51 has a first link member and a second link member. The first link member and the second link member are arranged so as to intersect with each other. The first link member and the second link member are coupled to each other through a shaft 51*a* in the central part of an intersecting portion and rotated about the shaft 51*a*. The first link member has one end pivotally supported by an engaging part 34*a* of the base plate 34 and the other end brought into abutment against the back surface of the key top 24. The second link member has one end pivotally supported by an engaging part 34*b* of the base plate 34 and the other end brought into abutment against the back surface of the key top 24.

The film actuator 31 is laminated with the film sensor 32 of the same shape as that. The film actuator 31 is an elastic member that generates a repulsive force corresponding to the position of the key top 24. The film actuator 31 has a portion arranged between the base plate 34 and the key top 24 and acting on the key top 24, which penetrates the inner periphery of the guide mechanism 51. The film actuator 31 is brought into contact with the lower surface of the key top 24, and both ends of the portion acting on the key top 24 are fixed to a receiving part 34*c* of the base plate 34.

The base plate 34 is made of a member having rigidity endurable to the key touch of the user, e.g., a metal and is formed approximately like a plate. The engaging parts 34*a* and 34*b* and the receiving part 34*c* are formed on the base plate 34.

Since the film actuator 31 is not stretched in the state in which no voltage is applied to the film actuator 31 as illustrated in FIG. 10, the key top 24 is at the bottom position and placed in a lower position to the frame 26. Further, as illustrated in FIG. 9, in the state in which the initial voltage is applied to the film actuator 31, the film actuator 31 is stretched to push the key top 24 upwards, so that the key top 24 is at the top position and placed in a higher position to the frame 26.

Incidentally, when the keyboard device 16 becomes active (e.g., where the PC main body is reset from a sleep state when the power supply thereof is ON, etc.), the keyboard controller 40 applies the initial applied voltage to the film actuator 31. When the keyboard device 16 becomes inactive (where a tablet configuration, i.e., configuration in which the keyboard device 16 of the main body side chassis 14 is exposed, is adapted in such a configuration that the display side chassis 12 is rotatable 360° relative to the main body side chassis 14 where the PC main body is in the sleep state when the power supply thereof is OFF, etc.), the keyboard controller 40 may turn OFF the voltage to be applied to the film actuator 31.

According to the present embodiment as described above, the keyboard device is equipped with the base plate 34, the key top 24 vertically movably arranged on the upper surface side of the base plate 34, the film actuator 31 arranged between the base plate 34 and the key top 24 and bent according to the applied voltage, the film sensor 32 arranged between the base plate 34 and the key top 24 and for detecting the position of the key top 24, and the keyboard controller 40 that applies the voltage to the film actuator 31 and generates the repulsive force according to the position of the key top 24 detected by the position sensor. Therefore, with an inexpensive and simple configuration, it is possible to obtain a repulsive force suitable for the user where the key top is depressed, while thinning the keyboard device. Additionally, the keyboard device can be made thinner as compared with the configuration where the rubber dome is used.

Further, it is possible to obtain a repulsive force more suitable when the key top is depressed than the case of using vibrations generated by haptic feedback, thereby making it possible to improve usability. Further, the keyboard device can be provided with an inexpensive and simple configuration as compared with the structure of generating a repulsive force by an electromagnetic coil mechanism.

Incidentally, in the above embodiment, the mechanism of generating the repulsive force by the film actuator 31 is applied to the keyboard device 16, but the present invention is not limited by or to this. The present invention can be applied even to a push button device mounted in an electronic apparatus or the like. In this case, the push button device can include as a basic configuration, a configuration equipped with a base, an operating member vertically movably arranged on the upper surface side of the base, a film actuator disposed between the base and the operating member and bent according to a voltage to be applied, a position sensor disposed between the base and the operating member and for detecting the position of the operating member, and control means that applies a voltage to the film actuator to generate a repulsive force corresponding to the position of the operating member detected by the position sensor.

As has been described, the present disclosure provides an improved thin keyboard design.

While the disclosure has been particularly shown and described with reference to a preferred embodiment, it will be understood by those skilled in the art that various changes in form and detail may be made therein without departing from the spirit and scope of the disclosure.

What is claimed is:

1. A keyboard device, comprising:

a base;

a rigid key top movably arranged on an upper surface of said base;

a film actuator, disposed between said base and said key top, bents according to an applied voltage;

a position sensor, disposed between said base and said key top, detects a position of said rigid key top relative to said base;

a guide mechanism connects said rigid key top to said base; and a controller applies a voltage to said film actuator to generate a repulsive force corresponding to said position of said rigid key top relative to said base as detected by said position sensor.

2. The keyboard device of claim 1, wherein said film actuator includes a piezoelectric film and a non-piezoelectric film.

3. The keyboard device of claim 1, wherein said position sensor is formed of the same material as said film actuator.

4. The keyboard device of claim 1, wherein said position sensor is a distance sensor.

5. The keyboard device of claim 1, wherein said position sensor is an electrostatic sensor.

6. A keyboard device, comprising:

a base;

a rigid key top movably arranged on an upper surface of said base;

a film actuator disposed between said base and said rigid key top, wherein said film actuator bents according to an applied voltage;

a position sensor disposed between said base and said rigid key top, wherein said position sensor provides a detected voltage according to a position of said rigid key top relative to said base;

a guide mechanism connects said rigid key top to said base; and a controller determines a voltage to be applied to said film actuator in order to generate a repulsive force, wherein said voltage is determined by relating said detected voltage from said position sensor to said position of said rigid key top relative to said base.

7. The keyboard of claim 6, wherein the relationship between said repulsive force and said position of said rigid key top relative to said base is non-linear.

8. The keyboard of claim 6, wherein said controller applies an initial voltage to said film actuator to place said rigid key top at a start position located higher than said base when said keyboard device is ready to receive inputs from a user.

* * * * *